US011745040B1

(12) United States Patent
Krull et al.

(10) Patent No.: US 11,745,040 B1
(45) Date of Patent: Sep. 5, 2023

(54) EXERCISE RESISTANCE METHODS AND APPARATUS

(71) Applicants: Mark A. Krull, New Braunfels, TX (US); Stephen P. Ihli, Santa Monica, CA (US)

(72) Inventors: Mark A. Krull, New Braunfels, TX (US); Stephen P. Ihli, Santa Monica, CA (US)

( * ) Notice: Subject to any disclaimer, the term of this patent is extended or adjusted under 35 U.S.C. 154(b) by 108 days.

(21) Appl. No.: 17/025,726

(22) Filed: Sep. 18, 2020

Related U.S. Application Data

(60) Provisional application No. 62/901,996, filed on Sep. 18, 2019.

(51) Int. Cl.
*A63B 21/015* (2006.01)
*A63B 21/00* (2006.01)
*A63B 21/04* (2006.01)

(52) U.S. Cl.
CPC ..... *A63B 21/015* (2013.01); *A63B 21/00069* (2013.01); *A63B 21/153* (2013.01); *A63B 21/4029* (2015.10); *A63B 21/4049* (2015.10); *A63B 21/0414* (2013.01)

(58) Field of Classification Search
CPC ..... A63B 21/015; A63B 21/153
See application file for complete search history.

(56) References Cited

U.S. PATENT DOCUMENTS 3,764,132 A * 10/1973 Hepburn ..... A63B 21/00069 482/123
6,030,321 A * 2/2000 Fuentes ..... A63B 21/4013 482/74
6,066,077 A * 5/2000 Horst ..... A63B 21/153 482/114
2003/0153441 A1* 8/2003 Berns ..... A63B 21/00069 482/124
2019/0160320 A1* 5/2019 Lagree ..... A63B 21/153

* cited by examiner

*Primary Examiner* — Jennifer Robertson

(57) ABSTRACT

An exercise apparatus includes a seat to accommodate a person in a seated position, an upper back rest to support the person's back, a foot rest to the person's feet, and a lap engaging member spanning the person's lap. A first resistance device is connected to opposite ends of the lap engaging member to resist movement of the lap engaging member away from the seat. A second resistance device is connected to a handle to resist movement of the handle from a position behind the back rest toward the back rest. A person sits on the seat and performs a combination exercise involving both: (a) a hip thrust exercise, wherein the person thrusts her hips and the lap engaging member upward and away from the seat; and (b) a lat pull down exercise, wherein the person pulls the handle from an arm's length distance behind the back support to a position more proximate the upper back support.

19 Claims, 8 Drawing Sheets

Fig. 2
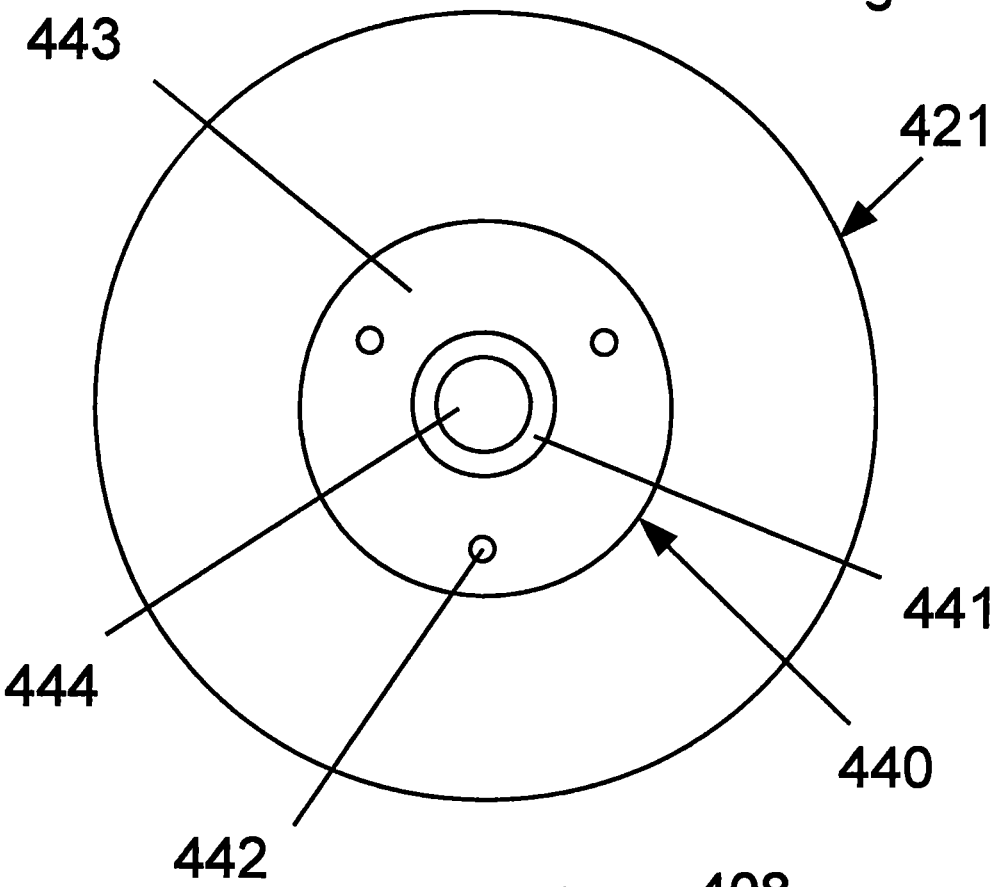
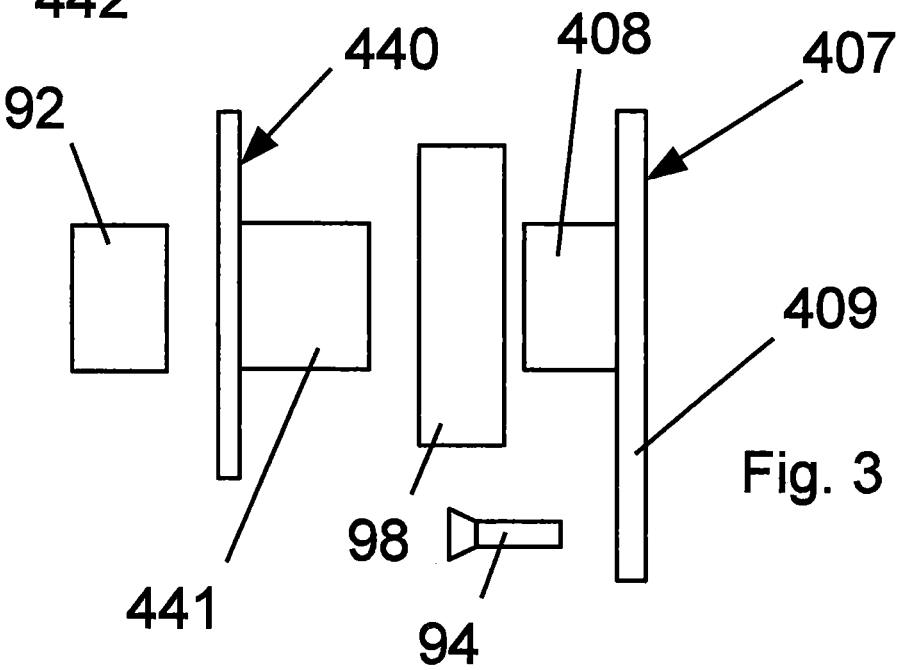
Fig. 3

Fig. 9a
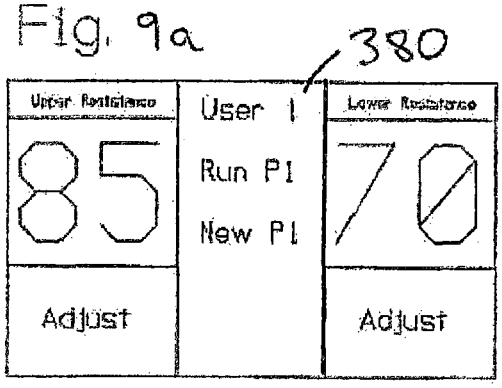
Fig. 9b
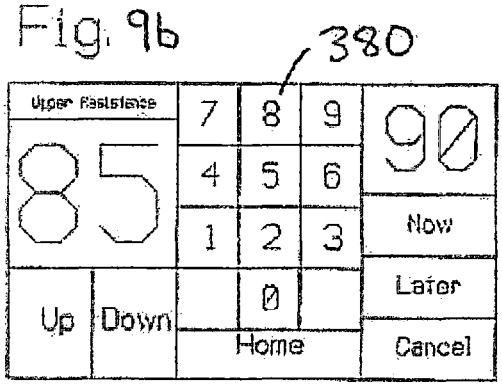
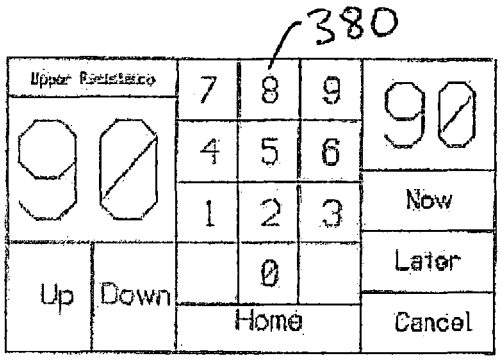
Fig. 9c
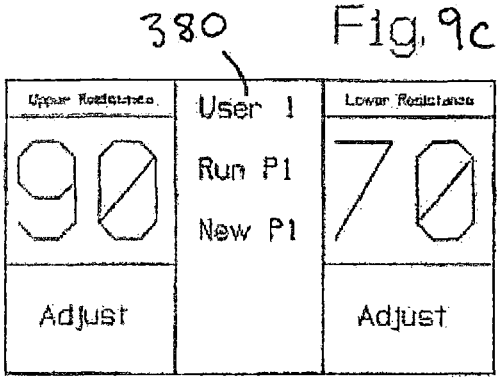
Fig. 9d
Fig. 10a
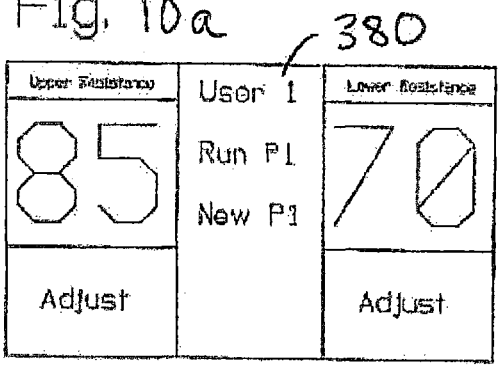
Fig. 10b
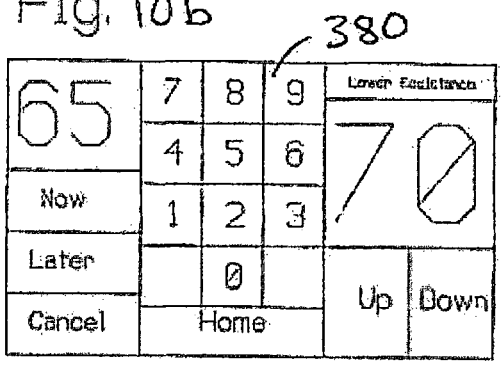
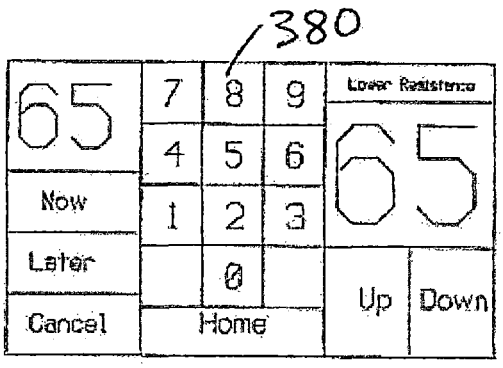
Fig. 10c
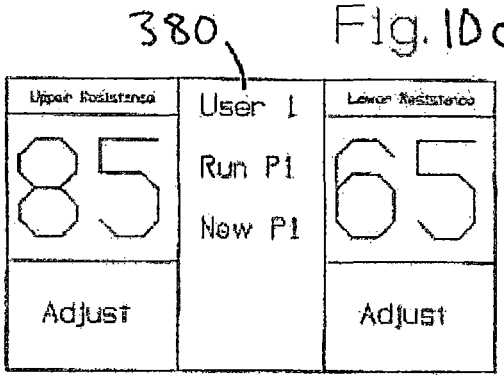
Fig. 10d Fig. 12
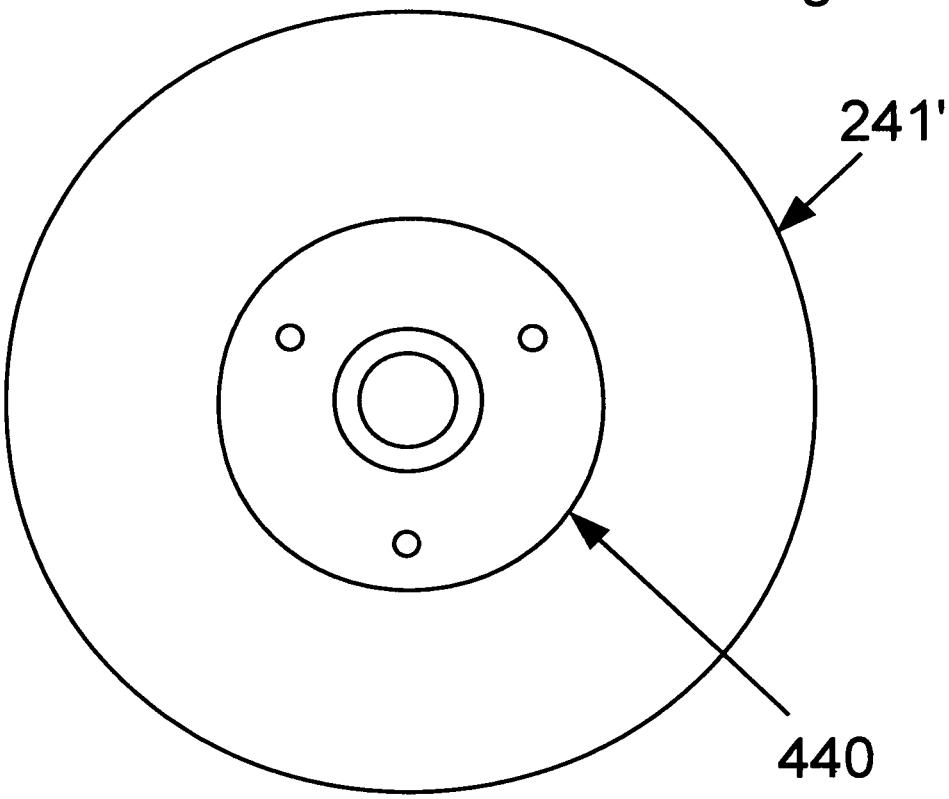
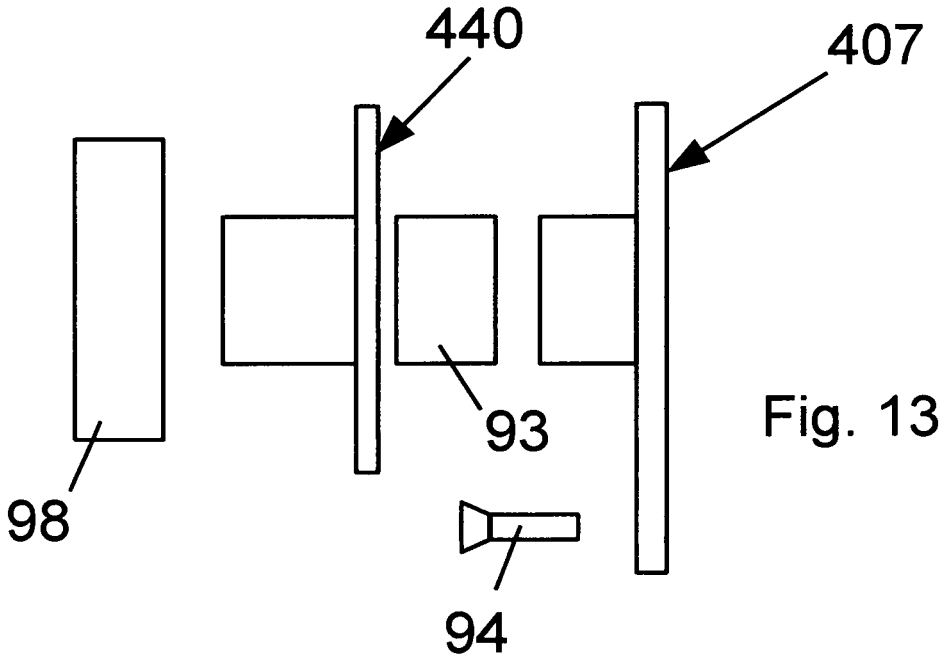
Fig. 13

EXERCISE RESISTANCE METHODS AND APPARATUS

CROSS-REFERENCE TO RELATED APPLICATION

Disclosed herein is subject matter entitled to the earlier filing date of U.S. Provisional Application No. 62/901,996, filed on Sep. 18, 2019.

FIELD OF THE INVENTION

The present invention relates to exercise resistance methods and apparatus, and more specifically, to exercise equipment that accommodates pulling at least one cord subject to a resistance load.

BACKGROUND OF THE INVENTION

An object of the present invention is to provide new and improved exercise resistance methods and apparatus. Some known exercise methods and apparatus are disclosed in U.S. Pat. Nos. 8,998,779 and 10,398,919 to Ihli et al. Another object of the present invention is to improve upon such methods and/or apparatus.

SUMMARY OF THE INVENTION

In one respect, the present invention may be described in terms of an exercise apparatus. One such exercise apparatus comprises a frame; a shaft supported on the frame and defining an axis; first and second brake drums mounted on the shaft for rotation about the axis; and a common resistance device operatively connected to each brake drum to resist rotation of each brake drum in a braking direction. First and second sheaves are mounted on the shaft for rotation about the axis. A first one-way clutch assembly is operatively interconnected between the first brake drum and the first sheave to constrain the first sheave and the first brake drum to rotate together in the braking direction and to allow the first sheave to rotate relative to the first brake drum in an opposite, rewind direction. A second one-way clutch assembly is operatively interconnected between the second brake drum and the second sheave to constrain the second sheave and the second brake drum to rotate together in the braking direction and to allow the second sheave to rotate relative to the second brake drum in the rewind direction. First and second cords are connected to respective shaves, and at least one of the cords is connected to a force receiving member.

In another respect, the present invention may be described in terms of a method of adjusting resistance to exercise. One such method involves providing an exercise apparatus having a frame; a shaft supported on the frame and defining an axis; left and right brake drums mounted on the shaft for rotation about the axis; and left and right brake band segments wrapped around portions of respective said left and right brake drums. Tension in the brake band segments is selectively simultaneously increased to increase resistance to rotation of both said brake drums, and selectively simultaneously decreased to decrease resistance to rotation of both said brake drums.

In yet another respect, the present invention may be described in terms of an exercise apparatus comprising a frame; a shaft supported on the frame and defining an axis; a sheave mounted on the shaft for rotation about the axis; a rewind spring interconnected between the sheave and the frame to bias the sheave to rotate in a rewind direction; a force receiving member; and a cord having a first end operatively connected to the sheave, and an opposite, second end operatively connected to the force receiving member, wherein the sheave includes a first sidewall and a second sidewall and a circumferential groove defined therebetween, and a radially oriented rib projects outward from the first sidewall to narrow a portion of the circumferential groove, whereby in response to rotation of the sheave in the rewind direction, as the cord winds about the sheave, the rib discourages the cord from stacking up against the first sidewall.

One or more aspects of the present invention may be implemented on various exercise equipment, including, for example, an exercise apparatus that accommodates performance of a hip-thrust and/or a lat-pull exercise. One such exercise apparatus is provided with a base, a seat mounted on the base, an upper back rest mounted on the base, a foot rest mounted on the base, a lap engaging member spanning the seat, a first resistance device mounted on the base and connected to the lap engaging member, at least one handle supported on the base behind the upper back rest, and a second resistance device mounted on the base and connected to said at least one handle. A person sits on the seat with his upper back resting against the upper back rest, and his feet resting on the foot platform, and the lap engaging member spanning his lap, and the handle in his hands. Subject to resistance imposed by the first resistance device through the lap engaging member, the person performs a hip-thrust exercise by pushing his hips upward and away from the seat while bracing his feet against the foot platform and his upper back against the upper back support. Subject to resistance imposed by the second resistance device through said at least one handle, the person performs a lat-pull exercise by pulling his hands toward his shoulders.

Display of the current resistance settings and/or adjustments to the resistance settings may be controlled electronically. For example, a touch-screen display and processing unit may be provided to track the resistance, calibrate the resistance, accommodate adjustments to the resistance, automatically adjust the resistance, delay activation of the resistance, track exercise activity, including resistance levels and exercise repetitions. In addition, relevant data may be sent and/or, received using a cellular phone or other input/output device.

The foregoing features of the present invention may be practiced individually and/or in various combinations with one another and/or with other features that will become apparent from the more detailed description that follows.

BRIEF DESCRIPTION OF THE DRAWING

With reference to the Figures of the Drawing, wherein like numerals represent like parts and assemblies throughout the several views, and wherein for ease of illustration, some parts of the invention are shown diagrammatically, are omitted from certain views, and/or overlap one another in certain views:

FIG. 2 is an end view of a sheave component on the exercise resistance device of FIG. 1;

FIG. 3 is a side view of a several components on the exercise resistance device of FIG. 1;

FIGS. 9*a*-9*d* are plan views of a touch-screen display on the exercise apparatus of FIG. 5, showing a first series of display screens;

FIGS. 10*a*-10*d* are plan views of a touch-screen display on the exercise apparatus of FIG. 5, showing a second series of display screens;

FIG. 12 is an end view of a sheave component on the exercise resistance device of FIG. 11; and FIG. 13 is a side view of a several components on the exercise resistance device of FIG. 11;

DETAILED DESCRIPTION OF THE PREFERRED EMBODIMENT

A first exercise apparatus constructed according to the principles of the present invention is designated as 100 in FIGS. 4 and 6-8. The exercise apparatus 100 includes a first resistance device 201 and a second resistance device 202, which could be identical, but are described herein as distinct both for ease of reference and to emphasize some of the possible variations of the subject invention. The resistance device 202 is disclosed in U.S. Pat. Nos. 8,998,779, and 10,398,919 to Ihli et al., which are incorporated herein by reference to supplement this disclosure regarding the construction, features, and/or use of the present invention.

Figure 1:
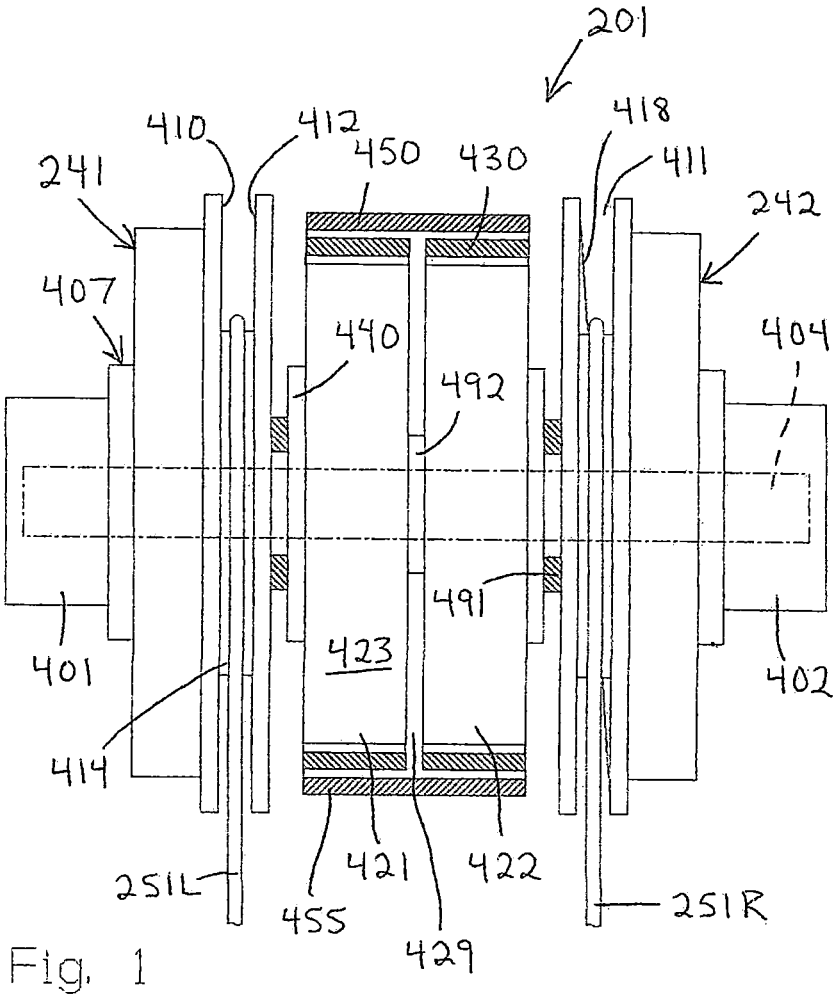
FIG. 1 is a partially sectioned top view of a first exercise resistance device constructed according to the principles of the present invention.

The resistance device 201 is similar in several respects to the resistance device 202, but different in certain key respects as further discussed herein (with the understanding that additional details also may be gleaned from the patents incorporated herein by reference). With reference to FIG. 1, the resistance device 201 has a stationary shaft 404 (shown in dashed lines) that is rigidly mounted on the frame 110, in this case, between left and right frame members 401 and 402. The shaft 404 is a cylindrical rod that defines a longitudinal axis. Left and right brake drums 421 and 422 are mounted on the shaft 404 for rotation about the axis. In this regard, FIG. 3 shows a conventional bearing 92, and one such bearing 92 is press fit into the center of each brake drum 421 and 422 and then mounted on the shaft 404 to rotatably mount each brake drum 421 and 422 onto the shaft 404. A washer 492 is mounted on the shaft 404 between the left brake drum 421 and the right brake drum 422, thereby defining or maintaining a gap 429 between the left brake drum 421 and the right brake drum 422. Each brake drum 421 and 422 accommodates a respective Kevlar brake strap 430 in a manner known in the art and disclosed in one or more of the incorporated references. Each brake drum 421 and 422 also defines a cylindrical brake surface 423 around which a respective brake strap 430 in wrapped.

A respective connector 440 is rigidly mounted on each brake drum 421 and 422. In this regard, FIG. 2 shows one such connector 440 connected to the left brake drum 421 by means of three conventional screws 442. The connector 440 is preferably made of steel and includes a disc-shaped plate portion 443 and a cylindrical tube portion or pipe 441. A circular hole or bore 444 extends through both the tube portion 441 and the plate portion 443 to accommodate the shaft 404 in slip fit fashion. The tube portion 441 inserts through a washer 491 and then through a conventional one-way clutch bearing 98 (shown in FIG. 3). One such one-way clutch bearing 98 is rigidly mounted concentrically within the center of each sheave 241 and 242 to operatively connect each sheave 241 and 242 onto a respective tube portion 441. As a result, each sheave 241 and 242 rotates in a first direction relative to a respective tube portion 441, but is locked against rotation in an opposite, second direction relative to a respective tube portion 441, and thus, rotates together with a respective tube portion 441 in the second direction.

Except for how the left sheave 241 is mounted on the tube portion 441, as described in the preceding paragraph, the left sheave 241 is similar to one or more of the sheaves disclosed in the incorporated references. As such, the sheave 241 includes a first portion to accommodate a flexible cord 251L, and a second portion or compartment to accommodate a rewind spring. Also as disclosed in one or more of the incorporated references, a spring bushing 407 is interconnected between the frame 110 and the inner end of the rewind spring. In this case, the spring bushing 407 is preferably an injection molded plastic part that defines a hub portion 408 about which the rewind spring is wrapped and to which the inner end of the rewind spring is anchored, and a plate portion 409 that is rigidly secured to the frame member 401 by at least one conventional screw 94.

The right sheave 242 is a modified mirror image of the left sheave 241. Both sheaves 241 and 242 include a hub 414, about which a respective cord 251L or 251R is wrapped, and outer and inner sidewalls 410 and 412, between which a respective cord 251L or 251R is wound. Each pair of sidewalls 410 and 412 defines a groove 411 therebetween, and this groove 411 has an axially measured width that is wider than the diameter of the cord 251L or 251R. The sole modification to the right sheave 242 is the provision of two ribs 418 projecting or extending into the groove 411. One such rib 418 extends upward in FIG. 1 and inward from the inner wall 412, and the other such rib extends downward in FIG. 1 and inward from the outer wall 410. Each rib 418 extends radially away from the shaft 404 and is preferably shaped as a half-cone that tapers radially or lengthwise as a function of distance from the shaft 404, to a termination point that falls short of the outer circumference of the pulley sidewalls 410 and 412. When the cord 251R is rewinding onto the sheave 242, once per revolution each rib 418 prevents the cord 251R from riding along a respective sidewall 410 or 412 and/or deflects the cord 251R away from a respective sidewall 410 or 412. As a result, the cord 251R is more likely to rewind evenly all across the hub 414, as opposed to accumulating or stacking up along one of the sidewalls 410 or 412.

FIG. 1 shows a first brake band 450 spanning both brake straps 430, was well as the gap 429 between the brake drums 421 and 422, and a diametrically opposite second brake band 455 spanning both brake straps 430, as well as the gap 429 between the brake drums 421 and 422. Each brake band 450 and 455 may also be described as spanning at least one-half and/or a majority of each brake surface 423 in a direction parallel to the shaft 404 and/or the axis defined by the shaft 404. Except as described herein, the brake bands 450 and 455 are similar to one or more of the brake band pairs disclosed in the patents incorporated by reference. They overlap in similar fashion and are selectively tightened or loosened in similar fashion. In this regard, a first end of each brake band 450 and 455 is anchored to a respective adjustment nut 235, and an opposite, second end of each brake band 450 and 455 is anchored to a respective frame member 236. The only modification to the brake bands 450 and 455 is that they are wide enough to span both brake drum surfaces 423 and/or both brake straps 430, and in fact, they span at least one-half and/or a majority of both brake drum surfaces 423 and both brake straps 430, as well as the gap 429 between the brake drums 421 and 422.

As a result of the foregoing arrangement, the resistance device 201 provides two separate but equal braking mechanisms, as opposed to one shared braking mechanism on the resistance device 202. In other words, the resistance delivered or provided by each brake drum 421 and 422 is determined by the tension in a common pair of brake bands 450 and 455, and a single adjustment mechanism adjusts that tension for both brake drums 421 and 422. Also, the left brake drum 421 is operatively connected to the left sheave 241, entirely independent of the right brake drum 422 and the right sheave 242, and vice versa, so the left brake drum 421 only rotates in response to rotation of the left sheave 241, and the right brake drum 422 only rotates in response to rotation of the right sheave 242. Additional details and/or comparisons are discussed below with reference to the exercise apparatus 100.

The exercise apparatus 100 includes a frame or base 110 configured to occupy a stable operating position on an underlying horizontal floor surface F. The base 110 is constructed in a manner known in the art and preferably comprises square steel tubes that are welded together to form a rigid frame 100 extending from a first or front end 112 to an opposite, second or rear end 114.

A horizontal foot support or platform 120 is mounted on the front end 112 of the frame 110. The foot platform 120 has an upwardly facing foot support surface 122 that is preferably defined by a rigid steel plate having a textured surface of a type known in the art. The height of the surface 122 above the floor F is preferably sixteen inches. The front resistance device 201 is disposed beneath and within the planform or perimeter of the surface 122. The resistance device 201 is secured to portions of the frame 110, and is preferably shrouded behind panels or sidewalls which are not shown in the drawings.

Figure 4:
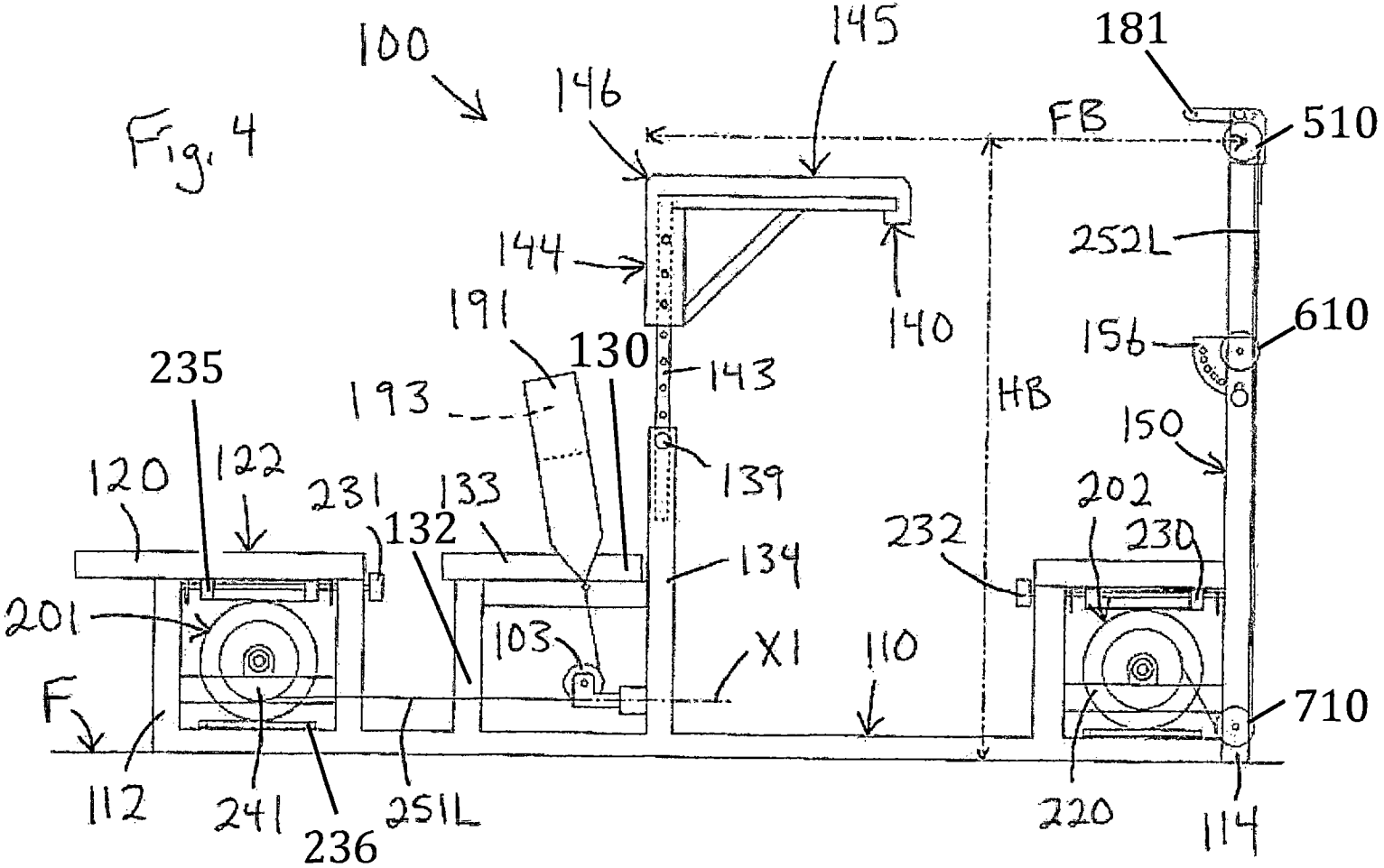
FIG. 4 is a left side view of a first exercise apparatus constructed according to the principles of the present invention and including the exercise resistance device of FIG. 1.
Figure 5:
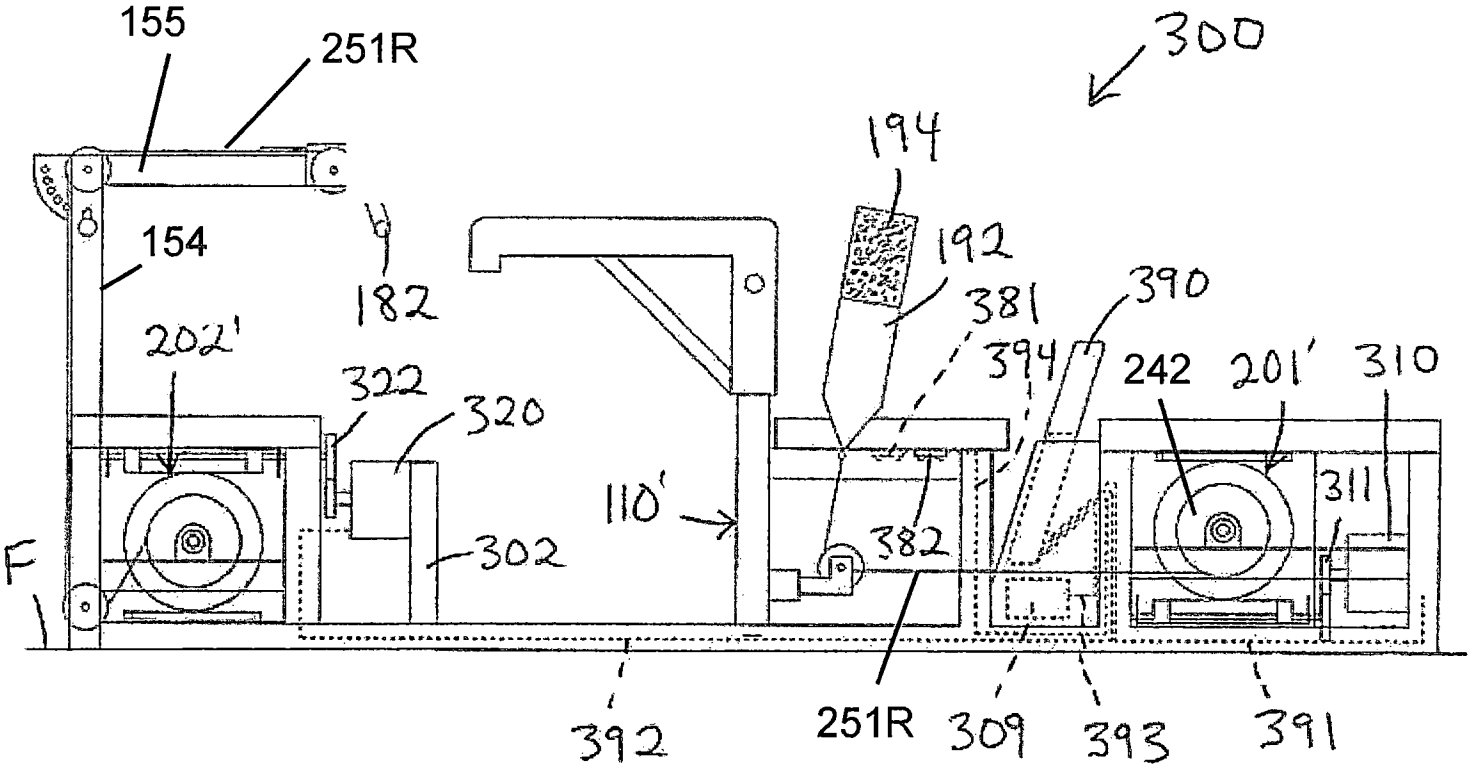
FIG. 5 is a right side view of a second exercise apparatus constructed according to the principles of the present invention.

With reference to FIGS. 1, 4, and 5, on the front resistance device 201, a right cord 251R has a first end connected to the right sheave 242, an opposite second end connected to a force receiving member (as further discussed below), and intermediate portions disposed therebetween, including a portion wrapped around the right sheave 242. Similarly, a left cord 251L has a first end connected to the left sheave 241, an opposite second end connected to a force receiving member (as further discussed below), and intermediate portions disposed therebetween, including a portion wrapped around the left sheave 241. As compared to FIGS. 1 and 11, FIGS. 4 and 5 show the sheaves smaller in diameter in relation to the brake drum(s) for ease of illustration and reference, and persons skilled in the art will recognize that the ratio between sheave diameters and brake drum diameters may be varied on alternative embodiments as a matter of design choice.

A chair 130 is rigidly mounted to an intermediate portion of the frame 110 and faces toward the foot support 120. The chair 130 includes left and right front legs 132 and left and right rear legs 134 configured and arranged to support a horizontal seat 133. The legs 132 and 134 are preferably square steel tubes that are welded to the longitudinally extending members of the frame 110, and thus, may alternatively be described as part of the frame 110. The seat 133 preferably includes padding sandwiched between a bottom board and an upper upholstery layer, all assembled in a manner known in the art to define an upwardly facing, horizontal seat surface.

The rear legs 134 extend upward beyond the seat 133 to provide sleeved posts that support an upper body support 140. The upper body support 140 includes left and right smaller square steel tubes 143 that telescope inside respective rear legs 134, and left and right larger square steel tubes that sleeve over respective rear legs 134. In a manner known in the art, a rod having a knob 139 on the end inserts through aligned holes in the rear legs 134 and the upper body support 140 to hold or latch the upper body support 140 in any of several positions or elevations above the floor surface F.

The upper body support 140 includes a first body supporting surface 144 that faces forward, toward the foot support 120, a second body supporting surface 145 that faces upward, away from the floor surface F, and a third body supporting surface 146 that transitions between the other two surfaces 144 and 145. The third body supporting surface 146 may be described as having an arcuate profile extending through at least 80 degrees at a radius of at least 2 inches. Like the seat 133, the upper body support 140 is padded and upholstered.

The upper body support 140 may also be described as having an L-shaped profile, with the first body supporting surface 144 defining one leg of the L, and the second body supporting surface 145 defining the other leg of the L. A brace is rigidly interconnected between the legs of the L for reinforcement purposes. The first body supporting surface 144 is configured and arranged to engage and support the upper back of a person sitting on the seat 133. The third body supporting surface 146 is configured and arranged to engage and serve as a brace to accommodate pivoting or rolling of the person's upper back from a vertical orientation to a horizontal orientation. The second body supporting surface 145 is configured and arranged to engage and support a person's upper back and head in a supine position.

Proximate a lower end of each rear leg 134, a respective pulley 103 is rotatably mounted on a bracket, which in turn, is rotatably mounted on the frame 110 for rotation about a respective horizontal axis X1. Each cord 251L and 251R has an intermediate segment routed from a respective sheave 241 or 242 to a respective pulley 103, and each such cord segment linearly aligns with a respective axis X1. As a result, each pulley 103 can pivot to the left or to the right without disrupting smooth and reliable passage and re-routing of a respective cord 251L or 251R. Recognizing that the orientation of the cord segment will vary based on how much cord is wrapped around the sheave, it may be said that at some point between minimum extraction and maximum extraction, the cord segment linearly aligns with the bracket axis X1, and/or the cord segment remains within five degrees of being co-linear with the bracket axis X1 throughout the range from minimum extraction to maximum extraction. Also, persons skilled in the art will recognize that additional intermediate pulleys may be used in a manner known in the art to move the the left cord 251L further to the left and/or to move the right cord 251R further to the right, as needed to accommodate differences in spacing between the ends of the cords attached to the sheaves and the ends of the cord attached to one or more force receiving members.

Each cord 251L and 251R has a terminal end segment connected to a respective force receiving member 191 or 192. The left and right force receiving members 191 and 192 may be described as complementary halves of an abdominal belt or lap engaging member 190. Each member 191 and 192 includes a panel or sheet preferably made of a robust and flexible material of a type known in the art for use on products such as weight lifting belts, including for example, nylon webbing or leather. A sheet or panel of loop-type Velcro fasteners 193 is secured to a downwardly facing side of the left belt member 191, and a sheet or panel of hook-type Velcro fasteners 194 is secured to an upwardly facing side of the right belt member 192. Persons skilled in the art will recognize that other belt fastening arrangements may be used without departing from the scope of the present invention, including for example, buckles or a single segment that loops about a buckle at the end of the one cord and then connects to itself via a buckle or hook-and-loop type fasteners. In any event, when the belt 190 is interconnected between the ends of the two cords 251L and 251R, it may be described as spanning the seat 133 and/or the lap of a person sitting on the seat 133.

A rear exercise assembly 150 is mounted on the rear end 114 of the frame 110. From a structural perspective, the assembly 150 may be described in terms of a chair configuration having relatively shorter left and right front legs and relatively longer left and right rear legs. The legs are preferably square steel tubes that are welded to the longitudinally extending members of the frame 110 and thus, may alternatively be described as part of the frame 110. The rear resistance device 202 is disposed within the planform or confines of the chair. The resistance device 202 is secured to portions of the frame 110, and is preferably shrouded behind panels or sidewalls and a top wall which are not shown in the drawings.

On the device 202, the adjustable brake assembly is designated as 230, and it adjusts tension in first and second brake bands wrapped around respective portions of a single brake drum 220 that is keyed to the shaft, which in turn, is rotatably mounted on the frame 110. A left sheave is connected to the shaft by a one-way clutch bearing, and the rewind spring is interconnected between the frame 110 and the left sheave. A right sheave is connected to the shaft by a one-way clutch bearing, and the rewind spring is interconnected between the frame 110 and the right sheave. A left cord 252L has a first end connected to the left sheave, an opposite second end connected to a force receiving member (as further discussed below), and intermediate portions disposed therebetween, including a portion wrapped around the left sheave. Similarly, a right cord 252R has a first end connected to the right sheave, an opposite second end connected to a force receiving member (as further discussed below), and intermediate portions disposed therebetween, including a portion wrapped around the right sheave.

Generally speaking, each device 201 and 202 may be described in terms of a shaft mounted on the frame and defining an axis; at least one brake drum mounted on the shaft for rotation about the axis; and an adjustable brake assembly mounted on the frame and operatively connected to the brake drum(s), including a respective user-operated adjustment knob 231 or 232 that is connected to a respective adjustment bolt and selectively rotated to increase or decrease tension in the respective brake bands.

A U-shaped arm 155 is rotatably mounted on the upper ends of the rear legs 154. Left and right brackets 156 are rigidly secured to respective left and right ends of the arm 155 for rotation with the arms 155 about a horizontal axis. A modified version of the rod associated with knob 139 (and described above with reference to the back support 140) has L-shaped appendages proximate each end of the rod. The distal ends of the appendages extend through aligned holes in the brackets 156 and the rear legs 154 to hold or latch the arm 155 in any of several orientations relative to the legs 154, from horizontal and extending forward to vertical and extending upward. Various known methods may be used to hold the above-described latching rods in place, including for example, ball detents or magnets. Persons skilled in the art will also recognize that other known arrangements may be used to selectively reorient the arm 155 relative to the frame 110.

Respective left and right pulleys 105 are rotatably mounted on respective left and right swivel brackets, which in turn, are rotatably mounted on respective distal left and right ends of the arm 155 for rotation about respective swivel axes. Each cord 252L and 252R has a terminal end segment connected to a respective force receiving member 181 or 182, each of which may alternatively be described as a conventional handle used in connection with weight stack cable machines. Each cord 252L and 252R has an intermediate segment routed from a respective handle 181 or 182 to a respective pulley 105, and each such cord segment linearly aligns with a respective swivel axis. As a result, each pulley 105 can pivot or swivel to the left or to the right without disrupting smooth and reliable passage and re-routing of a respective cord 252L or 252R. Each cord 252L and 252R has another intermediate segment routed from a respective pulley 105 to a respective upper idler pulley 106, which is rotatably mounted on an upper end of a respective rear leg 154 for rotation about the pivot axis of the U-shaped member 155. Each cord 252L and 252R has another intermediate segment routed from a respective upper idler pulley 106 to a respective lower idler pulley 107, which is rotatably mounted on a lower end of a respective rear leg for rotation about an axis that extends parallel to the other pulley axes (and parallel to the shaft of the resistance device 202). Each cord 252L and 252R has another intermediate segment routed from a respective lower idler pulley 107 to a respective sheave.

Figure 6:
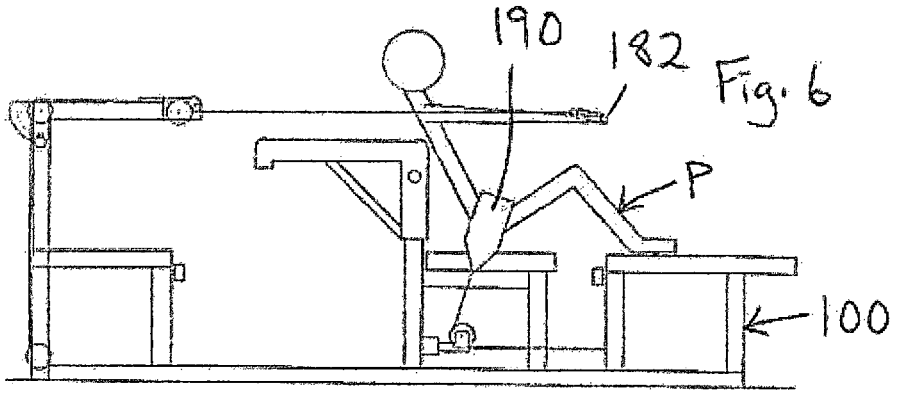
FIG. 6 is a right side view showing a relatively short person in a first exercise position on the exercise apparatus of FIG. 1.
Figure 7:
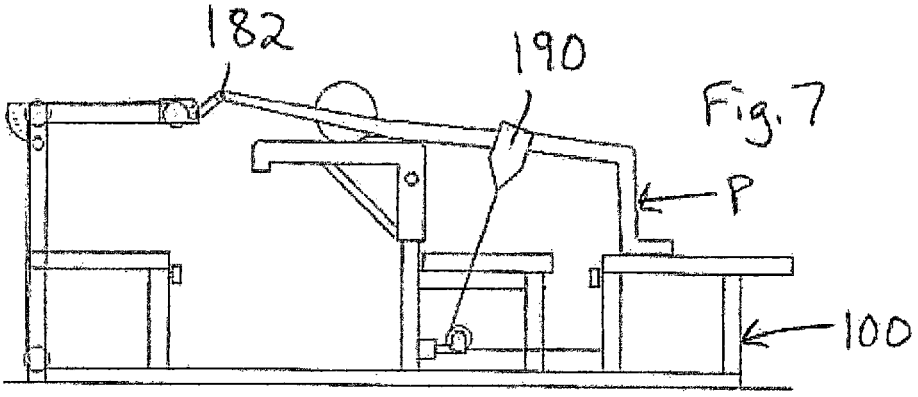
FIG. 7 is a right side view showing the relatively short person in a second exercise position on the exercise apparatus of FIG. 1.
Figure 8:
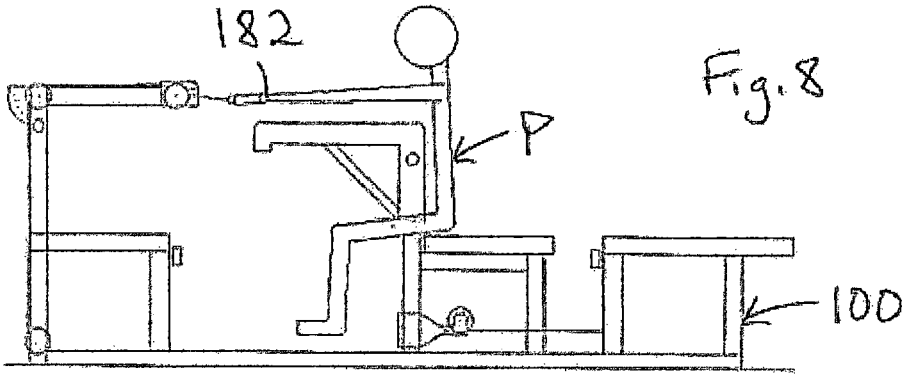
FIG. 8 is a right side view showing the relatively short person in a third exercise position on the exercise apparatus of FIG. 1.

FIGS. 6-8 show a person P using the exercise apparatus 100 to perform certain exercises. The person P is less than 5 feet tall, and the apparatus 100 has been adjusted accordingly. In this regard, the arm 155 is rotated to a horizontal orientation, placing the rotational axis of the pulley 105 at a height of 31 inches above the floor surface F and at a longitudinal distance of 29 inches rearward of the "chair back" or body supporting surface 144. For comparison, a person at least 6 feet 6 inches tall can alternatively adjust the apparatus 100 to be configured as shown in FIG. 4, with the rotational axis of the pulley 105 at a height HB of 48 inches above the floor surface F and at a longitudinal distance FB of 45 inches rearward of the "chair back" or body supporting surface 144. In each setting, the body supporting surface 145 is 3 inches below the pulley axis height.

In FIGS. 6 and 7, the person P is sitting on the seat 133 with her feet on the foot platform 120 and her upper back resting against the upper body support 140. The belt 190 is secured across the person's waist, and the handles 181 and 182 are in her respective left and right hands. FIG. 6 shows the person P at the start position for a hip-thrust exercise and at the end position for a lat-pull exercise. At the other extreme, FIG. 7 shows the person P at the end position for a hip-thrust exercise and at the start position for a lat-pull exercise. The person P can perform the two exercises at the same time or either exercise independent of the other. For example, in FIG. 6, if the person P releases the handles 181 and 182, she can perform just hip-thrust exercises; and in FIG. 7, if the person P releases herself from the ab belt 190, she can perform just lat-pull exercises. Alternatively, the person P can perform a combination exercise by transitioning between the positions shown in FIGS. 6 and 7, and the two exercises may proceed from the start position at the same time, or one may proceed from the start position while the other proceeds from the end position. An advantage of the present invention is that most of the resistance to exercise motion (anywhere from 5 to 300 pounds, for example) is generated by the resistance device 201 or 202 during the concentric portion of the exercise, while only the spring force (5 pounds, for example) is pulling the force receiving member back to the start position during the eccentric portion of the exercise. As a result, a person can perform compound exercises and/or maintain an eccentric position with one exercise member (e.g. the handles) while performing another exercise (e.g. the hip-thrust).

In FIG. 8, the person P is sitting backwards on the seat 133 with her chest resting against the upper body support 140, and the handles 181 and 182 in her opposite hands (because she has turned around). FIG. 8 shows the person P at the start position for a high-row exercise, which involves pulling the hands toward the shoulders. Another advantage of the present invention is that the resistance device 202 can accommodate "primarily concentric" exercises, in lieu of otherwise conventional exercises, simply by replacing a weight stack on an otherwise conventional exercise machine. Persons skilled in the art will recognize there are resulting advantages from not having the return force (of a weight stack) equal to the pull force (of a weight stack).

With reference to the foregoing exercises as performed on the apparatus 100, the exercises involving the handles 181 and 182 are subject to resistance from the rear resistance device 202. As a result, the two handles 181 and 182 are cooperating to overcome the load of a single brake drum, and the right arm of the person P is able to contribute more work than the left arm of the person P, or vice versa. To the contrary, the left and right ends of the ab belt 190 are subject to resistance from the front resistance device 201. As a result, the belt 190 must overcome the load of each brake drum 421 and 422, and neither side of the person P can compensate for the other side.

FIG. 5 shows a second exercise apparatus 300 constructed according to the principles of the present invention. Except as noted herein, the apparatus 300 is identical to the apparatus 100. The apparatus 300 has a frame 110' that is similar to the frame 100, but has been modified to accommodate some other differences between the apparatus 300 and the apparatus 100. One change involves the provision of modified resistance devices 201' and 202', which are similar to the resistance devices 201 and 202, except that the manually operated adjustment knobs 231 and 232 have been replaced by motorized adjustment mechanisms, and also, the resistance device 202' is a modified version of the resistance device 201.

Figure 11:
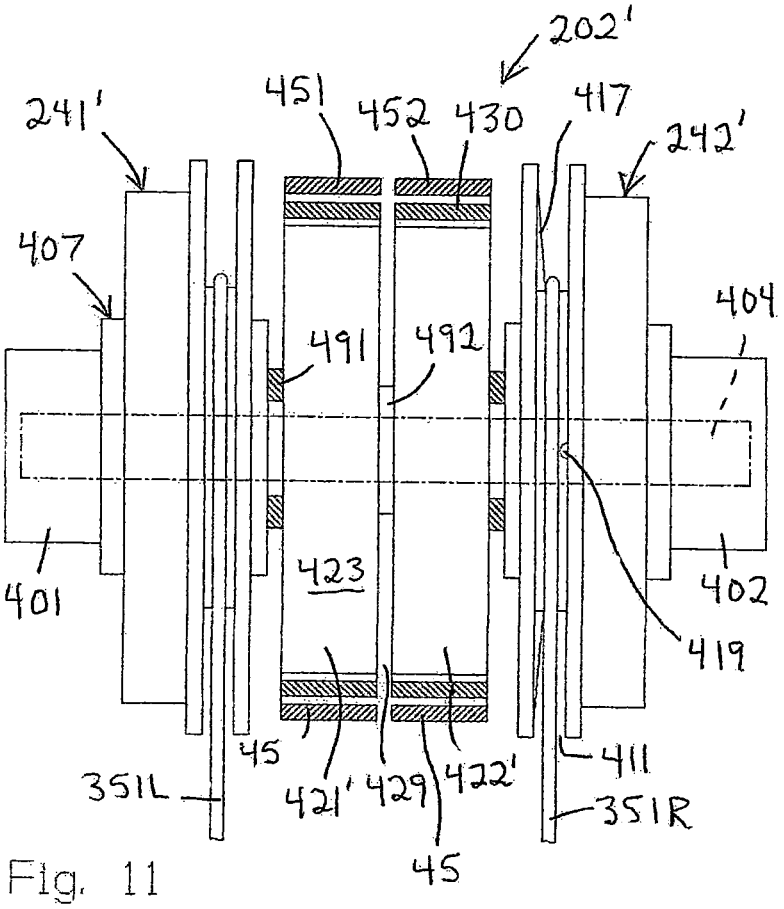
FIG. 11 is a partially sectioned top view of a second exercise resistance device constructed according to the principles of the present invention, and included on the exercise apparatus of FIG. 5.

The resistance device 202' is similar in most respects to the resistance device 201, but different in certain other respects as further discussed herein. With reference to FIG. 11, the resistance device 201 similarly has a stationary shaft 404 (shown in dashed lines) that is rigidly mounted on the frame 110', and more specifically, between left and right frame members 401 and 402. Generally speaking, as compared to the resistance device 201', the connectors 440 on the resistance device 202' have been "flipped" to switch how they interact with the sheaves and the brake drums. On the device 202', left and right sheaves 241' and 242' are mounted on the shaft 404 for rotation about the axis. In this regard, FIG. 13 shows a conventional bearing 93, and one such bearing 93 is press fit into the center of each sheave 241' and 242' and then mounted on the shaft 404 to rotatably mount each sheave 241' and 242' onto the shaft 404.

Except for how the left sheave 241' interacts with the shaft 404 and the connector 440, the left sheave 241' is similar to the left sheave 241. As such, the left sheave 241' includes a first portion to accommodate a flexible cord 351L, and a second portion or compartment to accommodate a rewind spring. A similar spring bushing 407 defines a hub portion 408 about which the rewind spring is wrapped and to which the inner end of the rewind spring is anchored, and a plate portion 409 that is rigidly secured to the left frame member 401 by at least one conventional screw 94.

The right sheave 242' is a modified mirror image of the left sheave 241'. The sole modification to the right sheave 242' is the provision of two pairs of ribs 417 and 419 projecting or extending into the groove 411. The ribs 417 and 419 are identical in size and shape to the ribs 418 on the sheave 242. The two ribs 417 extend upward and downward in FIG. 1 and inward from the inner wall 412. The two ribs 419 extend toward the reader and away from the reader in FIG. 1 and inward from the outer wall 410. Each rib 417 and 419 extends radially away from the shaft 404 and is preferably shaped as a half-cone that tapers radially or lengthwise as a function of distance from the shaft 404, to a termination point that falls short of the outer circumference of the pulley sidewalls 410 and 412. When the cord 351R is rewinding onto the sheave 242', twice per revolution the diametrically opposite ribs 417 prevent the cord 351R from riding along the inner sidewall 412 and/or deflect the cord 351R away from the inner sidewall 412, and the diametrically opposite ribs 419 prevent the cord 351R from riding along the outer sidewall 410 and/or deflect the cord 351R away from the outer sidewall 410. As a result, the cord 351R is more likely to rewind evenly all across the hub 414, as opposed to accumulating or stacking up along one of the sidewalls 410 or 412.

A respective connector 440 is rigidly mounted on each sheave 241' and 242'. In this regard, FIG. 12 shows one such connector 440 connected to the left sheave 241' by means of three conventional screws 442. As previously discussed with reference to FIGS. 2 and 3, the connector 440 is preferably made of steel and includes a disc-shaped plate portion 443 and a cylindrical tube portion or pipe 441. A circular hole 444 extends through both the tube portion 441 and the plate portion 443 to accommodate the shaft 404. The tube portion 441 inserts through a washer 491 and then through a conventional one-way clutch bearing 98 (shown in FIG. 13). One such one-way clutch bearing 98 is rigidly mounted concentrically within the center of each brake drum 421' and 422' to operatively connect each brake drum 421' and 422' onto a respective tube portion 441. As a result, each sheave 241' and 242' (and tube portion 441) rotates in a first direction relative to a respective brake drum 421' or 422', but is locked against rotation in an opposite, second direction relative to a respective brake drum 421' or 422', and thus, rotates together with a respective brake drum 421' or 422' in the second direction.

A washer 492 is mounted on the shaft 404 between the left brake drum 421' and the right brake drum 422', thereby defining a gap 429 between the left brake drum 421' and the right brake drum 422'. Except for how each brake drum 421' and 422' interacts with the shaft 404 and a respective connector 440, the brake drums 421' and 422' are similar to the brake drums 421 and 422. As such, each brake drum 421 and 422 accommodates a respective Kevlar brake strap 430 in a manner known in the art and disclosed in one or more of the incorporated references. Each brake drum 421 and 422 also defines a cylindrical brake surface 423 around which a respective brake strap 430 in wrapped.

FIG. 11 shows a first left brake band 451 overlapping one of the brake straps 430, namely the left brake strap, and an adjacent, second left brake band 452 overlapping the other brake strap 430, namely the right brake strap. Similarly, a second left brake band 456 overlaps a diametrically opposite portion of the left brake strap 430, and an adjacent, second right brake band 457 overlaps a diametrically opposite portion of the right brake strap 430. Except as described herein, the brake band pair 451 and 456 and the brake band pair 452 and 457 are similar to one or more of the brake band pairs disclosed in the patents incorporated by reference. They overlap in similar fashion and are selectively tightened or loosened in similar fashion. In this regard, a first end of each brake band 451 and 452 is anchored to one adjustment nut 235, and a first end of each brake band 452 and 457 is anchored to the other adjustment nut 235. An opposite, second end of each brake band 451 and 452 is anchored to one frame member 236, and an opposite second end of each brake band 456 and 457 is anchored to the other frame member 236. As a result of the foregoing arrangement, the resistance device 202' provides two separate but equal braking mechanisms, as opposed to one shared braking mechanism on the resistance device 202.

On the rear resistance device 202', the two adjustment nuts 235 are threaded onto respective ends of an adjustment assembly bolt, one using left-hand threads and the other using right-hand threads, as disclosed in the incorporated references. A first gear is mounted onto an end of the adjustment assembly bolt, and a second mating gear 322 is mounted on a shaft of a rotational motor 320, thereby linking rotation of the motor shaft to rotation of the adjustment assembly bolt. The frame 110' includes an additional member to support the motor 320. On the front resistance device 201', a first gear is mounted onto an end of the adjustment assembly bolt, and a second mating gear 311 is mounted on a shaft of a rotational motor 310, thereby linking rotation of the motor shaft to rotation of the adjustment assembly bolt. A forward member of the frame 110' is closer to the forward end of the foot platform 120 to accommodate and provide support for the motor 310. The term "motor" shall be interpreted to mean a conventional step motor and any associated components, including sensors, for example, which persons skilled in the art have used to make adjustments on commercially available exercise equipment.

Another change (or difference between the apparatus 300 and the apparatus 100) involves a housing (not numbered) between the foot support and the seat. The housing accommodates within its interior a power source 330. The housing also defines an upwardly opening compartment to slidably receive a controller 390 having a touch screen display 380. The controller 390 slides between a deployed position, shown in solid lines, wherein the display 380 is visible to a person sitting on the seat 133, and a stored position, shown in dashed lines, wherein the display 380 is hidden from a person sitting on the seat 133. Snap detents or other means known in the art are used to releasably hold the controller 390 in the deployed position. The term "controller" shall be interpreted to mean an electronic device that is hard-wired and/or programmed to interact with the motors 310 and 320 to make and monitor adjustments to the resistance devices 201' and 202', respectively.

A wire 393 extends from the controller 390 to the power source 309 to provide power to the controller 390. The power source 309 is known in the art and may be a replaceable rechargeable battery or a power adapting unit that plugs into an electrical socket. A wire 391 extends from the controller 390 to the motor 310 associated with the front resistance device 201'. The wire 391 sends power to the motor 310 and accommodates communication between the motor 310 and the controller 390. A wire 392 extends from the controller 390 to the motor 320 associated with the rear resistance device 202'. The wire 392 sends power to the motor 320 and accommodates communication between the motor 320 and the controller 390. Two wires 394 extend from the controller 390 to left and right buttons 381 and 382 disposed beneath respective left and right sides of the seat 133. The wires 394 accommodate communication from the buttons 381 and 382 to the controller 390. In a manner known in the art, the wires 391-394 are preferably routed through members of the frame 110' and/or along members of the frame 110', and the term "wire" shall be interpreted to mean at least one wire and/or a bundle of wires.

The control console is operable in different modes, including any combination of the following functions:

1. Monitoring operation of the first remote toggle switch that makes incremental changes to the first resistance device 201.
2. Monitoring operation of the second remote toggle switch that makes incremental changes to the second resistance device 202.
3. Displaying the current resistance setting for one or both resistance devices.
4. Displaying information to a user.
5. Displaying options to a user.
6. Receiving input from a user.
7. Running programs.

In one mode of operation, the controller 390 runs a control program that uses the screen displays shown in FIGS. 9*a*-9*d* and 10*a*-10*d*. As shown in FIGS. 9*a* and 10*a*, the left side of the Home Screen shows the current resistance setting for the rear or upper resistance device 202 (associated with the relatively high pulleys 105) and provides a button to adjust that resistance device 202. The right side of the Home Screen shows the current resistance setting for the front or lower resistance device 201 (associated with the relative low pulleys 103) and provides a button to adjust that resistance device 201. The middle of the Home Screen shows information regarding a specific user and allows the user to run a program and/or enter a program.

FIG. 9*b* shows the "Upper Resistance" screen that appears after a user touches the "Adjust" button beneath the Upper Resistance display in FIG. 9*a*. The left side of the Upper Resistance Screen looks like the Home Screen, except that the Adjust button has been replaced by "Up" and "Down" buttons. The middle of the Upper Resistance Screen provides a numeric keypad, as well as a "Home" button beneath the keypad. The Home button returns a user to the Home Screen. The right side of the Upper Resistance Screen provides a new resistance window above three additional buttons. The new resistance window shows an adjusted resistance setting based on user operation of the keypad and/or the Up and Down buttons. This window is highlighted as soon as any adjustment is entered (e.g. by flashing the new number and/or changing the background color). The Now button causes the newly entered resistance setting to be implemented as soon as the Now button is pushed, and then the newly entered resistance setting will appear in the large display box on the left side of the screen. The Later button causes the newly entered resistance setting to "flash" in the large display box on the left side of the screen, and then the controller waits until the associated remote toggle switch is operated, at which point, the newly entered resistance setting will be implemented, and will stop flashing in the large display box. FIG. 9*c* shows the screen that appears after a user touches the "Now" button or the "Later" button. The "Cancel" button simply resets the smaller display box to read the same as the larger display box. FIG. 9*d* shows the Home Screen after the Upper Resistance has been adjusted from 85 to 90 and the Home button has been pressed.

FIG. 10*b* shows the "Lower Resistance" screen that appears after a user touches the "Adjust" button beneath the Lower Resistance display in FIG. 10*a*. The right side of the Lower Resistance Screen looks like the Home Screen, except that the Adjust button has been replaced by "Up" and "Down" buttons. The middle of the Lower Resistance Screen provides a numeric keypad, as well as a "Home" button beneath the keypad. The Home button returns a user to the Home Screen. The left side of the Lower Resistance Screen provides a new resistance window above three additional buttons. The new resistance window shows an adjusted resistance setting based on user operation of the keypad and/or the Up and Down buttons. This window is highlighted as soon as any adjustment is entered (e.g. by flashing the new number and/or changing the background color). The Now button causes the newly entered resistance setting to be implemented as soon as the Now button is pushed, and then the newly entered resistance setting will appear in the large display box on the right side of the screen. The Later button causes the newly entered resistance setting to "flash" in the large display box on the right side of the screen, and then the controller waits until the associated remote toggle switch is operated, at which point, the newly entered resistance setting will be implemented, and will stop flashing in the large display box. FIG. 10*c* shows the screen that appears after a user touches the "Now" button or the "Later" button. The "Cancel" button simply resets the smaller display box to read the same as the larger display box. FIG. 10*d* shows the Home Screen after the Lower Resistance has been adjusted from 70 to 65 and the Home button has been pressed.

In response to a first control signal, the either motor 310 or 320 rotates in a first direction, causing the adjustment nuts to move away from one another, thereby increasing resistance to exercise. In response to a second control signal, either motor 310 or 320 rotates in an opposite, second direction, causing the adjustment nuts to move toward one another, thereby decreasing resistance to exercise. The control signals may be generated based on previously recorded data for a particular exercise routine and/or may be generated in real time based on a desire to change a resistance setting during exercise. For example, a person may toggle the button 382 "forward" to drive the motor 320 in the first direction or "rearward" to drive the motor 320 in the second direction. Similarly, a person may toggle the button 381 "forward" to drive the motor 310 in the first direction or "rearward" to drive the motor 310 in the second direction. An advantage of the buttons 381 and 382 is that a person can adjust resistance without leaving the exercise position, especially since only minimal rewind force is imposed on the force receiving members. When the person has entered "Later" into the controller 390, the person may get situated on the apparatus 300 and then push the button 381 or 382 once in either direction to cause a respective motor 310 or 320 to set the associated resistance to the pre-programmed amount. An advantage of this feature is that the person can maneuver the force receiving member(s), the handles 181 and 182 and/or the belt 190, into desired starting positions subject only to the force(s) imposed by the rewind spring(s).

With reference to the exercises of FIGS. 6-8 being performed on the apparatus 300, the exercises involving the handles 181 and 182 are now subject to resistance from the resistance device 202'. As a result, each of the handles 181 and 182 must overcome the load of a respective brake drum 421' and 422', and neither side of the person P can compensate for the other side. As with the resistance device 201, the load or resistance generated or provided by the brake drums 421' and 422' is separate and equal and simultaneously adjustable.

An otherwise conventional cell phone may be provided with an app that is compatible and in communication with the control unit 390. The app generates user screens on the cell phone, including a start-up screen which allows a user to register, sign in as someone already registered, or start without registering or signing in. The app then offers the user options for exercise routines, including an option that simply involves adjusting resistance by pushing a "+" button or a "−" button. If a registered user selects a previously used routine, the app will automatically adjust resistance to predetermined levels based on stored data from the previous workout. If a new routine is selected, the app will automatically adjust resistance to "best guess" levels based on data known about the user. In any event, the user can adjust the resist manually at any time and/or signal when a desired level of resistance should be saved in connection with a particular exercise. The app and/or the control unit 390 preferably includes memory for purposes of storing information from one use to the next. Also, a port (not shown), such as a USB port, is preferably connected to the device 390 to receive a removable memory device, such as a flash drive, for purposes of storing data in a portable format.

The subject invention has been described with reference to specific embodiments and particular applications with the understanding that features of the subject invention may be practiced individually and/or in various combinations and/or on various types of exercise equipment. Also, persons skilled in the art will recognize that various modifications may be made to the preferred embodiment, in any of its applications, without departing from the scope of the subject invention. Furthermore, alternative embodiments may be made with different component materials, structures, and/or spatial relationships, and nonetheless fall within the scope of the present invention. In view of the foregoing, the subject invention should be limited only to the extent of allowable claims that issue from this

What is claimed is:

1. An exercise apparatus, comprising:

a frame;

a shaft supported on the frame and defining an axis;

a first brake drum mounted on the shaft for rotation about the axis;

a second brake drum mounted on the shaft for rotation about the axis;

a common resistance device operatively connected to each said brake drum to resist rotation of each said brake drum in a braking direction;

a first sheave mounted on the shaft for rotation about the axis;

a second sheave mounted on the shaft for rotation about the axis;

a first one-way clutch assembly operatively interconnected between the first brake drum and the first sheave to constrain the first sheave and the first brake drum to rotate together in the braking direction and to allow the first sheave to rotate relative to the first brake drum in an opposite, rewind direction;

a second one-way clutch assembly operatively interconnected between the second brake drum and the second sheave to constrain the second sheave and the second brake drum to rotate together in the braking direction and to allow the second sheave to rotate relative to the second brake drum in the rewind direction;

at least one force receiving member;

a first cord having a first end and an opposite, second end, wherein the first end is operatively connected to the first sheave; and a second cord having a first end and an opposite, second end, wherein the first end of the second cord is operatively connected to the second sheave, and at least one said second end is operatively interconnected to the force receiving member.

2. The exercise apparatus of claim 1, further comprising a second force receiving member, wherein the second end of the first cord is operatively connected to said force receiving member, and the second end of the second cord is operatively connected to said second force receiving member.

3. The exercise apparatus of claim 1, wherein the resistance device includes at least one band wrapped around at least a portion of each said brake drum.

4. The exercise apparatus of claim 3, wherein a gap is defined between the first brake drum and the second brake drum, and said at least one band includes a band that spans the gap and said portion of each said brake drum.

5. The exercise apparatus of claim 3, wherein each said brake drum defines a cylindrical brake surface, and in a direction measured parallel to the axis, said at least one band includes a band that spans more than half of each said brake surface.

6. The exercise apparatus of claim 3, wherein each said brake drum defines a cylindrical brake surface, and further comprising a first brake strap disposed about at least a majority of the brake surface on the first brake drum, and a second brake strap disposed about at least a majority of the brake surface on the second brake drum, and each said brake strap is squeezed between a respective said brake surface and said at least one band.

7. The exercise apparatus of claim 6, wherein said at least one band includes a first band that wraps around a first half of each said brake drum, and a second band that wraps around an opposite, second half of each said brake drum, and the resistance device includes a single adjustment mechanism that is operable to adjust tension in each said band.

8. The exercise apparatus of claim 3, wherein the resistance device includes a single adjustment mechanism that is operable to adjust tension in each said band.

9. The exercise apparatus of claim 8, wherein each said band includes a first end operatively connected to the single adjustment mechanism, and an opposite, second end connected to the frame.

10. The exercise apparatus of claim 9, wherein said at least one band includes a first band that wraps around a first half of each said brake drum, and a second band that wraps around an opposite, second half of each said brake drum.

11. The exercise apparatus of claim 1, wherein each said one-way clutch assembly includes a cylindrical tube rigidly mounted on a respective said sheave, and a one-way clutch bearing concentrically disposed around the tube and inside a respective said brake drum.

12. The exercise apparatus of claim 1, wherein each said one-way clutch assembly includes a cylindrical tube rigidly mounted on a respective said brake drum, and a one-way clutch bearing concentrically disposed around the tube and inside a respective said sheave.

13. The exercise apparatus of claim 1, wherein the first sheave includes a first sidewall and a second sidewall and a circumferential groove defined therebetween, and a radially oriented rib projects outward from the first sidewall to narrow a portion of the circumferential groove, whereby as the first cord winds about the first sheave, the rib discourages the cord from stacking up against the first sidewall.

14. An exercise apparatus, comprising:

a frame;

a shaft supported on the frame and defining an axis;

a sheave mounted on the shaft for rotation about the axis;

a rewind spring interconnected between the sheave and the frame to bias the sheave to rotate in a rewind direction;

a force receiving member;

a cord having a first end operatively connected to the sheave, and an opposite, second end operatively connected to the force receiving member, wherein the sheave includes a first sidewall and a second sidewall and a circumferential groove defined therebetween, and a radially oriented rib projects outward from the first sidewall to narrow a portion of the circumferential groove, whereby in response to rotation of the sheave in the rewind direction, as the cord winds about the sheave, the rib discourages the cord from stacking up against the first sidewall.

15. The exercise apparatus of claim 14, wherein a second radially oriented rib projects outward from the second sidewall to narrow a diametrically opposite portion of the circumferential groove, whereby as the cord winds about the sheave, the second rib discourages the cord from stacking up against the second sidewall.

16. The exercise apparatus of claim 14, wherein a second radially oriented rib projects outward from the first sidewall to narrow a diametrically opposite portion of the circumferential groove, whereby as the cord winds about the sheave, the second rib discourages the cord from stacking up against the first sidewall.

17. The exercise apparatus of claim 14, further comprising a brake drum mounted on the shaft for rotation about the axis; and a one-way clutch assembly operatively interconnected between the brake drum and the sheave to constrain the sheave and the brake drum to rotate together in a braking direction and to allow the sheave to rotate relative to the brake drum in an opposite, rewind direction.

18. A method of adjusting resistance to exercise, comprising the steps of:

providing an exercise apparatus having a frame; a shaft supported on the frame and defining an axis; left and right brake drums mounted on the shaft for rotation about the axis; and left and right brake band segments wrapped around portions of respective said left and right brake drums;

selectively simultaneously increasing tension in the brake band segments to increase resistance to rotation of both said brake drums; and selectively simultaneously decreasing tension in the brake band segments to decrease resistance to rotation of both said brake drums.

19. The method of claim 18, wherein the providing step further includes providing left and right second brake band segments wrapped about second portions of respective said brake drums diametrically opposite said left and right brake band segments, and the increasing tension step involves simultaneously increasing tension in all said brake band segments, and the decreasing tension step involves simultaneously decreasing tension in all said brake band segments.

* * * * *